United States Patent [19]

Ayyoubi

[11] Patent Number: 4,717,039

[45] Date of Patent: Jan. 5, 1988

[54] CONTAINER RECLOSING DEVICE

[76] Inventor: Luay Ayyoubi, P.O. Box 8636, The Woodlands, Tex. 77387-8636

[21] Appl. No.: 926,914

[22] Filed: Nov. 3, 1986

[51] Int. Cl.[4] ..... B65D 51/18

[52] U.S. Cl. ..... 220/253; 220/258; 220/336

[58] Field of Search ..... 220/253, 258, 336, 269; 222/480, 516, 548

[56] References Cited

U.S. PATENT DOCUMENTS 2,172,452 9/1939 Rese ..... 220/336

4,463,866 8/1984 Mandeh ..... 220/258

*Primary Examiner*—George T. Hall

*Attorney, Agent, or Firm*—Ned L. Conley; William E. Shull; Paul F. Simpson

[57] ABSTRACT

A reclosing apparatus for reclosing an open container while still laden with contents, to inhibit spillage of the contents. The reclosing apparatus comprises a plate mounted about the central post of a container top for rotating between open and closed positions. The plate includes an axis bore for receiving the central post therethrough, and a sealing region for effecting a spill-resistant seal over the opening in the container top. The sealing region may include a seal depression and/or a seal ridge. When the reclosing apparatus is in the closed position, the seal depression protrudes through the opening, effecting at least a partial spill-resistant seal therewith. The seal ridge, if included, is formed in the plate to matingly align with a border ridge formed in the container top around the periphery of the opening. The reclosing apapratus optionally may also include a straw hole for withdrawing liquid contents while the opening is partly sealed, and a finger grip to aid in rotating the reclosing apparatus around the central post.

9 Claims, 7 Drawing Figures

CONTAINER RECLOSING DEVICE

BACKGROUND OF THE INVENTION

The present invention relates to apparatus for closing a container, and more particularly to apparatus for reclosing a container after initial opening. Still more particularly, the present invention relates to apparatus for reclosing a container to inhibit spillage of retained contents, especially liquid contents, after initial opening of the container.

Any container is, obviously, intended to contain the contents held within. A problem exists, however, particularly with containers intended to hold liquids. Once the container is opened, such opening being necessary to withdraw the fluid contents, the likelihood of liquid spillage from the container is increased. Many containers, such as, for example, soft drink cans with pull tab opening devices, lack any means for reclosing after opening, to minimize or prevent spillage.

Numerous situations exist in which the inability to reclose a container creates a continuous hazard of liquid spillage. Open cans or containers on tables on countertops, inside refrigerators, and in many other locations are prone to being toppled. Parents particularly must deal with the annoyance of children having open containers, especially in moving vehicles, laden with still-unconsumed liquids. Such containers are easily dropped by small hands, or set down to fall over later, creating an often sticky mess. With the wide openings provided for drinking, liquid flows freely and readily when such a container is toppled or overturned.

The problem of spillage exists even when such containers are in use. The wide openings intended for drinking, as noted, readily permit fluid passage therethrough. If a container in use is dropped or excessively jostled, liquids inside can flow or splash out. Yet, an opening must be present for the liquid contents to be withdrawn.

It can be seen, therefore, that a need exists for apparatus to effect reclosing of a container, especially a liquid container after initial opening. The reclosing apparatus would, preferably, be usable while the liquids are either being consumed or being stored for later use or discarded. Such a reclosing apparatus would inhibit or prevent spillage and mess, and could further lengthen the effective life of the contained fluid.

SUMMARY OF THE INVENTION

Accordingly, there is provided herein a container reclosing apparatus comprising a plate adapted to be rotatably attached to a central post on a container top, the plate having a sealing region adapted to slidably cover or uncover an opening in the top. The reclosing apparatus is designed to be combined with a container top when the top is initially installed on the container. The reclosing apparatus is in an "open" position prior to opening of the container, and rotated away from the future location of the opening. The reclosing apparatus is subsequently rotated about the central post to a "closed" position to cover the opening. In the case, for example, of a conventional container having a permanent pull tab mounted to a central post, the reclosing apparatus is to be disposed below the pull tab, and is attached to the pull tab or is held to the top by being mounted on the central post below the pull tab.

The sealing region of the plate may include a seal depression and/or a seal ridge for effecting a spill-resistant seal over the opening in the top. The seal depression is formed in the plate to protrude into the opening. Side walls of the seal depression may also contact the edges of the opening, to minimize spillage. The seal ridge may be provided on the plate of the reclosing apparatus for reclosing can tops that have a border ridge formed around the opening. Such a border ridge is often formed in the top, projecting longitudinally inward or outward, and is disposed about the exterior periphery of the opening. The seal ridge, if included, is formed on the plate of the reclosing apparatus. The seal ridge is formed to be matingly correlative to the border ridge, whereby the seal ridge may seat against and around the border ridge, effecting a spill-resistant seal therebetween.

The reclosing apparatus optionally may include additional features enhancing its operation and performance. A straw hole through the plate can be included. Positioning the straw hole over the opening reduces the risk of spillage, yet allows insertion of a straw into the can interior, for withdrawing the liquid contents. Further, the reclosing apparatus may include a finger grip formed on the surface of the plate, for facilitating rotation of the apparatus between open and closed positions. The finger grip can be a series of formed ridges on the plate, or may include any other means for increasing sliding friction between the plate and a finger, or other implement, used to rotate the reclosing apparatus.

Accordingly, Applicant's invention provides an inexpensive, yet effective, apparatus for reclosing an open container to reduce the risk of spilling the container's contents. The apparatus is simple to build and install, and enhances the use of containers while extending the lift of container contents. These and various other characteristics and advantages of the present invention will become readily apparent to those skilled in the art upon reading the following detailed description and claims, and by referring to the accompanying drawings.

BRIEF DESCRIPTION OF THE DRAWINGS

For a more detailed description of the preferred embodiment of the invention, reference will now be made to the accompanying drawings, wherein.

DESCRIPTION OF THE PREFERRED EMBODMENT

All containers, particularly containers of liquids, possess the inherent hazard of spillage of the contents after initial opening of the container. Liquid contents, especially, are prone to spillage if not consumed entirely and immediately after initial opening of the container. When the liquid is not fully consumed, and the container is in use or is set aside for any period of time, the risk of spillage is increased. A container may be easily toppled or dropped while still laden with fluid contents. It is thus desirable to limit the risk of spillage while accessing and withdrawing the fluid contents within, and while the container is unused, but retains some remnant of the fluid contents.

Figure 1:
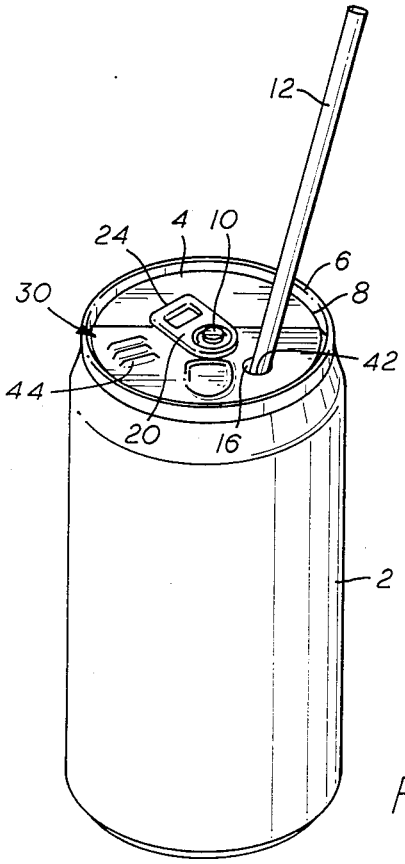
FIG. 1 shows a perspective view of a container reclosing device of the present invention, installed and in use on a conventional soft drink can.

Applicant's invention disclosed herein provides a simple reclosing device for installation on a container prior to initial opening. Referring to FIG. 1, there is shown therein a perspective view of a conventional soft drink can 2 with the container reclosing apparatus 30 of the present invention installed thereon. While a particular style of conventional soft drink container is depicted in the figures herein, it will be understood that the present invention will be applicable to a variety of containers having details of design and construction differing from the particular details described and depicted herein.

Figure 7:
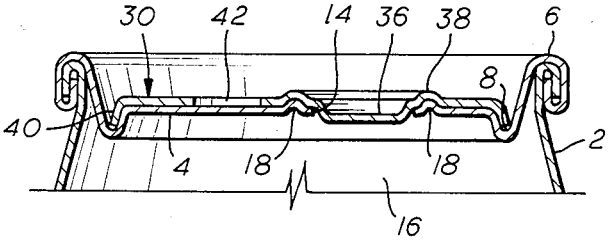
FIG. 7 shows a partial, cross-sectional view taken along lines 7—7 of FIG. 6.

With reference to FIG. 1 and FIG. 7, the can 2 has relatively thin walls, with a top 4 made from a plate having a similar thickness. The top 4 is joined to the walls of the can 2 to effect a pressure-type fluid seal therebetween. The top 4 includes a circumferential upper edge 6 above the body of the can 2. A circumferential channel 8 encircles the interior of the top 4, and is disposed below and radially inward from the upper edge 6. Substantially in the center of the top 4, coaxial with the cylindrical axis of the can 2, is a central rivet or post 10. Secured to the central post 10 is a pull tab 20, with a handle 24 disposed at the opposite end of the pull tab 20 from the central post 10, enabling a user to open the can 2 without use of additional implements.

Figure 3:
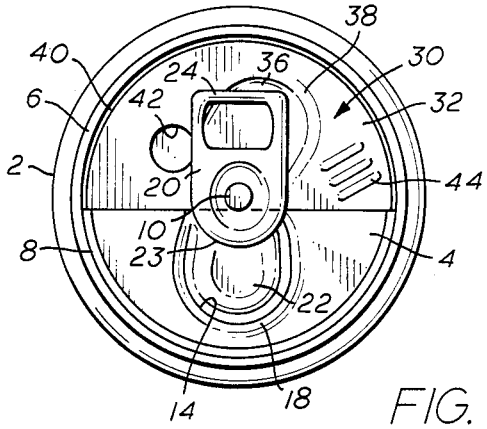
FIG. 3 shows a plan view of the can and installed container reclosing device of FIG. 1, prior to opening of the can.

With reference to FIG. 3, the can 2 is depicted therein prior to opening. A seal plate 22, disposed on substantially the opposite side of the central post 10 from the pull tab 20, seals the can 2 shut. The seal plate 22 is typically part of the plate of the top 4, with scoring around the edge of the seal plate 22 to allow predetermined breakage along such scoring. The seal plate 22 is surrounded by a raised border ridge 18, pressed into the plate of the top 4, as can be seen most clearly in FIG. 7.

Figure 4:
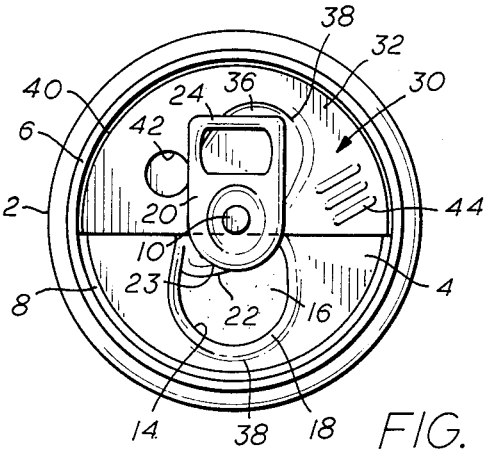
FIG. 4 shows a plan view of the can and container reclosing device of FIG. 1, after initial opening of the can.

With reference now to FIG. 3 and FIG. 4, when the handle 24 is pulled upward, away from the top 4, the pull tab 20 pivots about the central post 10, and the opposite end of the pull tab 20 from the handle 24 travels downward, toward the seal plate 22. The seal plate 22 is depressed downwardly, until it breaks free along the scored edges, pivoting about a point at or near the central post 10. An opening 14 in the top 4 is then created, exposing the interior 16 of the can 2 to allow withdrawal of the liquid contents. Additionally, when the handle 24 is pulled to depress the seal plate 22, the central post 10 often also pivots about the plane of the top 4, becoming angularly displaced relative to the longitudinal axis of the can 2. The longitudinal, rotational axis of the central post 10 thus becomes angularly disposed relative to the axis of the can 2. The rotational axis of the central post 10 is thus normal to a plane that intersects the plane of the top 4 at approximately the central post 10, and extends downward, into the containter 2, in the direction of the seal plate 22. The interplay between this axial angular displacement and the reclosing apparatus 30 will be addressed in more detail below.

Figure 2:
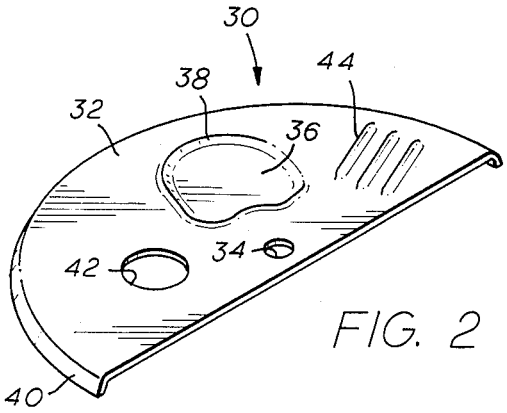
FIG. 2 shows a perspective view, in isolation, of the container reclosing device of FIG. 1.

With reference to FIG. 2, the reclosing apparatus 30 includes a single plate or body 32 having a combination of various holes, depressions, and other surface features. The body 32 is intended to be constructed with the top 4 and in place prior to initial opening of the can 2. The body 32 is installed between the top 4 and the body of the pull tab 20. The body 32 as shown in FIG. 2 is generally semicircular in shape, although any other shape that would effect the reclosing of the can 2 in a similar fashion would be suitable. The outer diameter defined by the circumference of the body 32 is substantially equal to the outer diameter of the channel 8 of the top 4. The body 32 includes an axis bore 34 substantially in the center of the circle defined by the semicircular body 32. As can be seen in FIG. 3, the axis bore 34 is sized to allow the central post 10 to be received therethrough, yet sufficiently small to provide a snug, rotatable fit of the body 32 about the central post 10.

The body 32 further includes a seal depression 36, as can be seen most clearly in FIG. 7. The seal depression is configured to protrude through the opening 14 in the top 4. As will be described in more detail hereinafter, the seal depression 36 aids in sealing and seating of the reclosing apparatus 30. A seal ridge 38 is disposed around most or all of the periphery of the seal depression 36. The seal ridge 38 is a feature molded into the body 32, projecting in the same longitudinal direction as the border ridge 18. As will also be described hereinafter, the seal ridge 38 is configured to mate with the border ridge 18 surrounding the opening 14 in the top 4. For containers lacking such a border ridge 18, the seal ridge 38 would be unnecessary and, hence, deleted.

An integral, downwardly angled rim 40 is disposed along the circumference of the body 32. The base of the rim 40 extends far enough downward, below the plane of the rest of the body 32, to hold the rim 40 within the channel 8 when the reclosing apparatus 30 is installed on the can 2, as shown in FIG. 7. The reclosing apparatus 30 further includes a straw hole 42 through the body 32. The straw hole 42 penetrates the body 32, and accommodates a conventional straw 12, as can be seen in FIG. 1, for drinking the liquid contents of the can 2. Lastly, a finger grip 44, shown in FIG. 2 in the form of a series of elevated ridges formed in the body 32, provides convenient means for applying force with a finger, or other implement, to the body 32 to rotate the reclosing apparatus 30 about the central post 10, as will be described in more detail below.

With reference now to FIGS. 3–6, there are shown therein the sequence of steps for opening the can 2 and subsequently utilizing the reclosing apparatus 30 of the present invention. As can be seen in FIG. 3, prior to opening of the top 4 by pulling the handle 24 of the pull tab 20, the reclosing apparatus 30 is rotated, about the central post 10, away from the seal plate 22. With further reference to FIG. 4, there is shown therein the top 4 and the reclosing apparatus 30 in substantially the same position as in FIG. 3. As shown in FIG. 4, however, the pull tab 20 has depressed the seal plate 22 into the interior 16 of the can 2, thereby forming the opening 14 through the top 4, surrounded by the border ridge 18. As depicted in FIG. 4, the can 2 can be used for withdrawing or pouring the liquid contents in any conventional manner.

Figure 5:
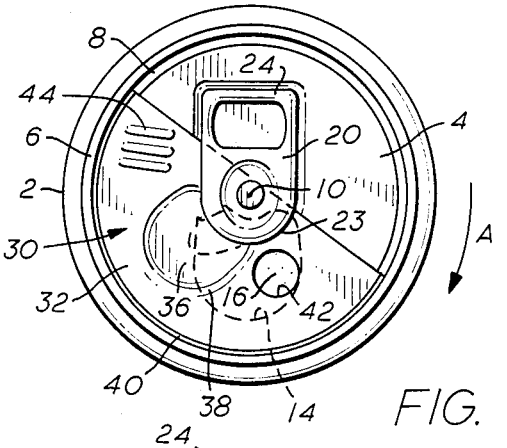
FIG. 5 shows a plan view of the can and container reclosing device in use, as shown in FIG. 1, but with the straw deleted for clarity.

With reference now to FIG. 5, the reclosing apparatus 30 is shown therein partially rotated, in the direction of the arrow A, to a position wherein the straw hole 42 is disposed above the hole 14, allowing access to the interior 16. With reference also to FIG. 1, a straw 12 can now be inserted through the straw hole 42 for drinking the liquid contents of the can 2. In the position shown in FIG. 5, therefore, the reclosing apparatus 30 allows access to, and withdrawal of, the liquid contents of the can 2, but minimizes the hazard and likelihood of spillage of the liquid during such withdrawal and use.

It will be noted that, as depicted in FIG. 5, the reclosing apparatus 30 is rotated to a position in which the seal depression 36 is rotated to a position in which the seal depression 36 is disposed above the border ridge 18. The construction of the reclosing apparatus 30 allows the seal depression 36 to "ride over" the border ridge relatively easily. As can be seen in FIG. 7, the edges of the seal depression 36 are gently sloped and lack any abrupt edges, thereby permitting smooth rotation of the reclosing apparatus 30 as the seal depression 36 rises to allow the body 32 to pass over the border ridge 18.

Figure 6:
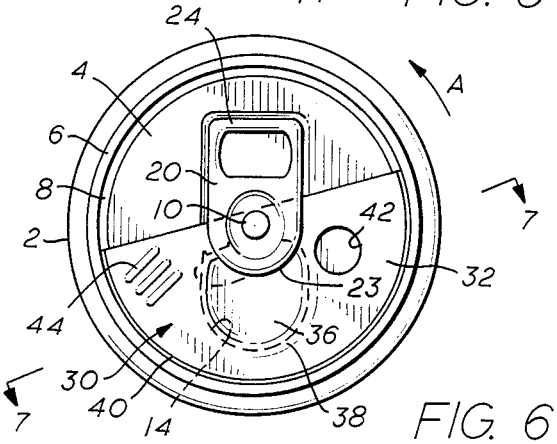
FIG. 6 shows a plan view of the can and reclosing device of FIG. 1, with the reclosing device in the closed position.

With reference now to FIG. 6, the reclosing apparatus 30 is shown therein rotated to the closed position. The straw hole 42 is rotated away from the opening 14, and is disposed only above the body of the top 4. With further reference to FIG. 7, the closing apparatus, in the closed position, effects a spill-resistant seal over the opening 14. The seal depression 36 is configured to project into the opening 14, within the borders thereof. The seal depression 36 thus tends to anchor the closing apparatus 30 from rotating accidentally or inadvertently from the closed position. The seal depression 36 also helps provide partial sealing of the hole 14, to the extent that the edges of the seal depression 36 impinge against the walls of the hole 14. In addition, the seal ridge 38 conforms to all or substantially all of the border ridge 18 surrounding the hole 14. The seal ridge 38 thus effects another spill-resistant seal around the periphery of the opening 14 when the closing apparatus 30 is rotated into the closed position, as shown in FIGS. 6 and 7.

It should be noted that the reclosing apparatus 30 utilizes several mechanisms in effecting a seal and in maintaining a closed position. The rim 40 conforms to the channel 8 disposed on the circumference of the top 4, thereby facilitating rotation of the reclosing apparatus 30, while also tending to hold the body 32 substantially flat relative to the top 4. More-over, as discussed supra, when the handle 24 is pulled to depress the seal plate 22, the longitudinal, rotational axis of the central post 10 typically rotates to be angularly disposed from the longitudinal axis of the can 2. The longitudinal axis of the can 2, in turn, is normal to the plane of the top 4. Since the reclosing apparatus 30 rotates around the longitudinal axis of the central post 10, the angular disposition of the central post 10 relative to the top 4 causes the body 32 to press more tightly against the top 4 as the body 32 is rotated toward the closed position shown in FIGS. 6 and 7. The body 32, therefore, presses against the top 4 when in the closed position, and thus the seal ridge 38 tends to seat tightly against the border ridge 18, and the seal depression 36 tends to seat firmly inside the hole 14. The seating of the seal depression 36 and the seal ridge 38 serves at least a twofold purpose. First, the spill-resistant capability of the reclosing apparatus 30 is enhanced, due to the additional seating pressure between the seal ridge 38 and the border ridge 18. Second, the tendency of the reclosing apparatus 30 to oppose rotation away from the closed position is enhanced, due to the tighter engagement of the seal depression 36 within the hole 14.

After the handle 24 has been pulled upwardly initially to open can 2, typically the handle 24 will be pushed back down by the user, ultimately to be disposed at an acute angle with respect to the top 4, in a direction beginning at central post 10 and proceeding radially outwardly and upwardly, relative to the top 4, to the end of handle 24. The opposite end 23 of tab 20 will, on the other hand, be disposed at an acute angle radially outwardly and downwardly with respect to the top 4. In addition, in most cases the tab 20 is free to rotate in either a clockwise or counterclockwise direction about the cylindrical axis of post 10. In the event that a person with insufficient manual dexterity or digital strength finds it difficult at times to rotate the apparatus 30 away from a sealed, closed position, for example to reopen the container, the pull tab 20 can be used as a lever to assist such person to lift and disengage the seal depression 36 from the opening 14. This will facilitate subsequent rotation of the body 32 about post 10 to reopen the container. To effect such lever action, the upper surface of the seal depression 36 can be provided with a raised slot (not shown) to receive end 23 of tab 20 thereunder. Handle 24 is rotated clockwise or counterclockwise as necessary or convenient and end 23 is manipulated to position end 23 under such raised slot. Pushing the opposite end of tab 20 down toward top 4 causes the tab 20 to act as a lever, with post 20 as the fulcrum, and the end 23 is lifted up, carrying the seal depression 36 upward, disengaged from opening 14. Simultaneously with such lifting, rotational force can be applied to body 32, as at grip means 44, to move the reclosing apparatus 30 to a container-opened position.

It can be seen, therefore, that Applicant's invention provides a simple, economical, convenient apparatus for reclosing containers after initial opening, to inhibit and mitigate loss or spillage of contents of such container. The reclosing apparatus disclosed herein achieves such ends both during use and during storage of a container and the liquid contents therein. The reclosing apparatus of the present invention can be adapted for a variety of styles, sizes, and shapes of containers.

Those skilled in the art will appreciate that the foregoing list of attributes and advantages is not exhaustive of the features of the present invention. It will be appreciated that modifications to the described preferred embodiments of the invention can be made without departing from the substance and spirit of the invention. In particular, alternative means can be provided for mounting the reclosing apparatus 30 to the top 4, such as securing the reclosing apparatus 30 directly to the pull tab 20. The pull tab 20 might then also be utilized for rotating the reclosing apparatus 30 into a closed position. Further, various modifications and alterations could be made to be precise configuration of the seal depression 36 and/or the seal ridge 38, depending upon the exact nature and configuration of the hole 14 to be reclosed. Such alternative seal depression 36 and/or seal ridge 38 might effect partial or complete coverage of the hole 14 upon rotating the closing apparatus into the closed position.

What is claimed is:

1. An apparatus for reclosing a container having a top with an opening therethrough, a circumferential channel disposed radially outward from the opening, and a central post, said apparatus comprising:

a plate having a rim disposed on the periphery thereof for engaging the channel when said plate is rotatably attached to the central post, a sealing region of said plate being adapted for slidably, alternately covering and uncovering the opening, said sealing region including a seal depression formed in said plate for protruding through the opening.

2. The apparatus of claim 1, wherein said seal depression is configured to contact inner edges of the opening when said seal depression protrudes through the opening.

3. The apparatus of claim 1, wherein the top includes a border ridge formed thereon and disposed about the external periphery of the opening, and said sealing region includes a seal ridge formed thereon, substantially correlative to the border ridge for matingly aligning therewith.

4. The apparatus of claim 3, wherein said seal ridge is disposed about the external periphery of said seal depression.

5. The apparatus of claim 1, wherein said rim is integral with said plate.

6. The apparatus of claim 1, wherein said plate includes an axis bore therethrough, and said plate rotatably attaches to the central post by receiving the central post within said axis bore.

7. The apparatus of claim 1, wherein said plate includes a grip formed therein and having indentations formed in said plate.

8. An apparatus for reclosing a container having a top, the top including an opening therethrough, a central post, a border ridge formed therein and disposed about the periphery of the opening, and a circumferential channel disposed radially outward from the opening, comprising:

a plate for being rotatably attached to the central post, said plate having an axis bore therethrough for receiving the central post therein;

said plate further having a sealing region thereon being adapted for slidably, alternately covering and uncovering the opening;

said sealing region including a seal depression and a seal ridge formed in said plate, said seal depression being adapted for protruding through the opening, and said seal ridge being substantially correlative to the border ridge for matingly aligning therewith;

said plate further including an integral rim disposed on the periphery thereof for engaging the channel when said plate is rotatably attached to the central post; and said plate further including a grip formed therein and having indentations formed in said plate.

9. The apparatus of claim 1, wherein said plate includes a hole sized to permit passage of a drinking straw therethrough and positioned on said plate for allowing such passage while said plate covers any remainder portion of the opening not disposed directly below said hole.

* * * * *